US006084514A

United States Patent [19]

Kopp et al.

[11] Patent Number: 6,084,514

[45] Date of Patent: Jul. 4, 2000

[54] APPARATUS FOR DEACTIVATION OF ELECTRONIC ARTICLE SURVEILLANCE TAGS

[75] Inventors: Markus B. Kopp, Deerfield Beach; Wayne H. Martin, Boca Raton, both of Fla.

[73] Assignee: Sensormatic Electronics Corporation, Boca Raton, Fla.

[21] Appl. No.: 08/721,123

[22] Filed: Sep. 26, 1996

[51] Int. Cl.[7] ..... G08B 13/14

[52] U.S. Cl. ..... 340/572.3; 340/551; 324/228; 361/149; 361/143; 361/269; 335/284

[58] Field of Search ..... 340/572, 551, 340/572.3, 572.8, 572.1; 324/228, 267, 143, 146; 361/149, 150, 151, 152; 343/867, 908; 335/284

[56] References Cited

U.S. PATENT DOCUMENTS

| | | | |
|---|---|---|---|
| 4,300,183 | 11/1981 | Richardson | 361/152 |
| 4,617,603 | 10/1986 | Johnson et al. | 361/149 |
| 4,665,387 | 5/1987 | Cooper et al. | 340/572 |
| 4,829,397 | 5/1989 | Vernikov et al. | 361/149 |
| 5,032,792 | 7/1991 | Wing et al. | 324/228 |
| 5,126,720 | 6/1992 | Zhou et al. | 340/572 |
| 5,534,836 | 7/1996 | Schenkel et al. | 335/284 |

FOREIGN PATENT DOCUMENTS

| | | | |
|---|---|---|---|
| 0703552A1 | 3/1996 | European Pat. Off. | G08B 13/24 |

*Primary Examiner*—Benjamin C. Lee
*Attorney, Agent, or Firm*—Paul T. Kashimba

[57] ABSTRACT

An apparatus for deactivating a surveillance tag comprising a first coil located in a first plane, a second coil located in a second plane, and a third coil located in a third plane such that the third plane intersects the first and second planes at an angle that is greater than zero degrees and less than ninety degrees.

19 Claims, 5 Drawing Sheets

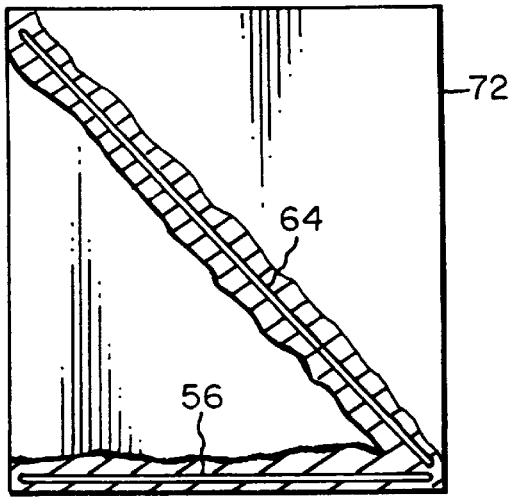
FIG. 5
FIG. 6
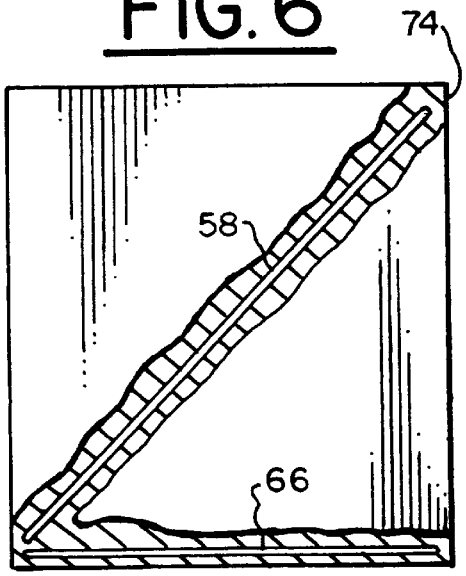
FIG. 7
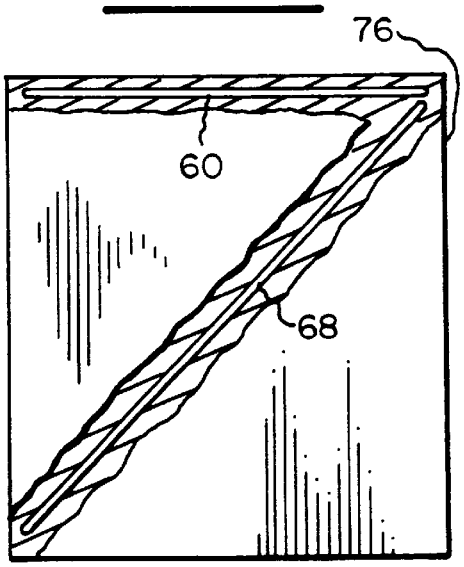
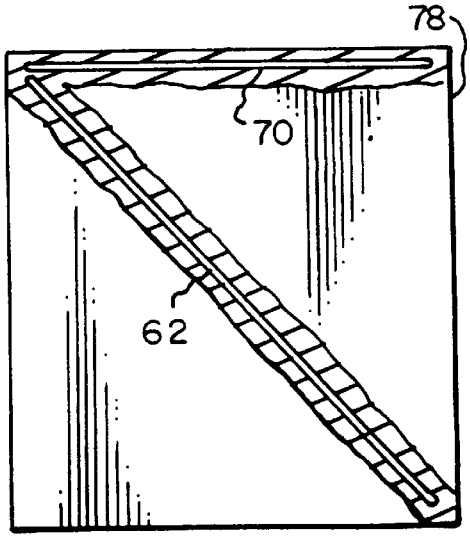
FIG. 8

APPARATUS FOR DEACTIVATION OF ELECTRONIC ARTICLE SURVEILLANCE TAGS

FIELD OF THE INVENTION

This invention relates to electronic article surveillance and, more particularly, to deactivating electronic article surveillance tags.

BACKGROUND OF THE INVENTION

Electronic article surveillance (EAS) systems have employed either reusable EAS tags or disposable EAS tags to monitor articles. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices use coils which are energized to generate a magnetic field of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally coplanar with the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk places a bag or bulk container into the cavity and then places the tagged articles into the bag. After all of the articles have been placed into the bag or when the bag is full, the clerk energizes the coils to deactivate all of the EAS tags in the bag. The clerk then lifts the bag out of the cavity. This system provides deactivation of multiple tags at one time and does not require specific orientation of the tags.

Many retail establishments having high volume find it desirable to deactivate multiple tags at one time rather than passing each item over a deactivation coil in a specific orientation. However, the prior art systems require the checkout clerk to lift the bag of articles out of the cavity which can be fatiguing to the checkout clerk. In addition, the prior art systems require six coils to deactivate the EAS tags located in the cavity, thus requiring significant initial equipment expense and significant energy operating expense.

SUMMARY OF THE INVENTION

In accordance with the present invention there is provided an apparatus for deactivating a surveillance tag comprising a first coil located in a first plane, a second coil located in a second plane, and a third coil located in a third plane. The third plane intersects the first and second planes at an angle that is greater than zero degrees and less than ninety degrees. In a preferred embodiment, the first and second planes are parallel and the third plane is collinear with a diagonal of the first and second planes, and, preferably, the third plane intersects the first and second planes at an angle of approximately forty-five degrees.

The present invention also provides an apparatus for bagging articles and deactivating surveillance tags associated with those articles. The apparatus comprises a bagging station having at least three sides and a bottom defining a volume suitable for containing a bag; and less than four deactivation coils positioned around the volume so that the resulting field provided by the coils deactivates surveillance tags in the volume.

In addition, the present invention provides an apparatus for deactivating a surveillance tag comprising a first coil located in a first plane, and a second coil located in a second plane with the second plane intersecting the first plane and being positioned so that a first side of the first coil is orthogonal to a first side of the second coil.

Accordingly, the present invention provides a first improved deactivation coil arrangement in which only three deactivation coils are required to deactivate EAS tags located in a predetermined volume or cavity. These three deactivation coils can be positioned so that a bagging station associated with the coils needs only three sides and a bottom thereby allowing a checkout clerk to remove the bag in a horizontal position rather than lifting the bag out of the cavity. In addition, the three coils require less initial equipment expense for the system and less electrical energy for operation. It should be noted that if desired the three coil arrangement can be used in a bagging station having four sides and a bottom. In a second improved deactivation coil arrangement only two deactivation coils are required. This results in a further decrease in initial equipment costs and a reduced electrical energy operating cost.

Other objectives, advantages, and applications of the present invention will be made apparent by the following detailed description of the preferred embodiment of the invention.

DESCRIPTION OF THE DRAWINGS

FIG. 5 is a partially cut away front view of the bagging station of FIG. 4.

FIG. 6 is a partially cut away side view of the bagging station of FIG. 4.

FIG. 7 is a partially cut away back view of the bagging station of FIG. 4.

FIG. 8 is a partially cut away side view of the bagging station of FIG. 4.

DETAILED DESCRIPTION OF PREFERRED EMBODIMENTS

Figure 1:
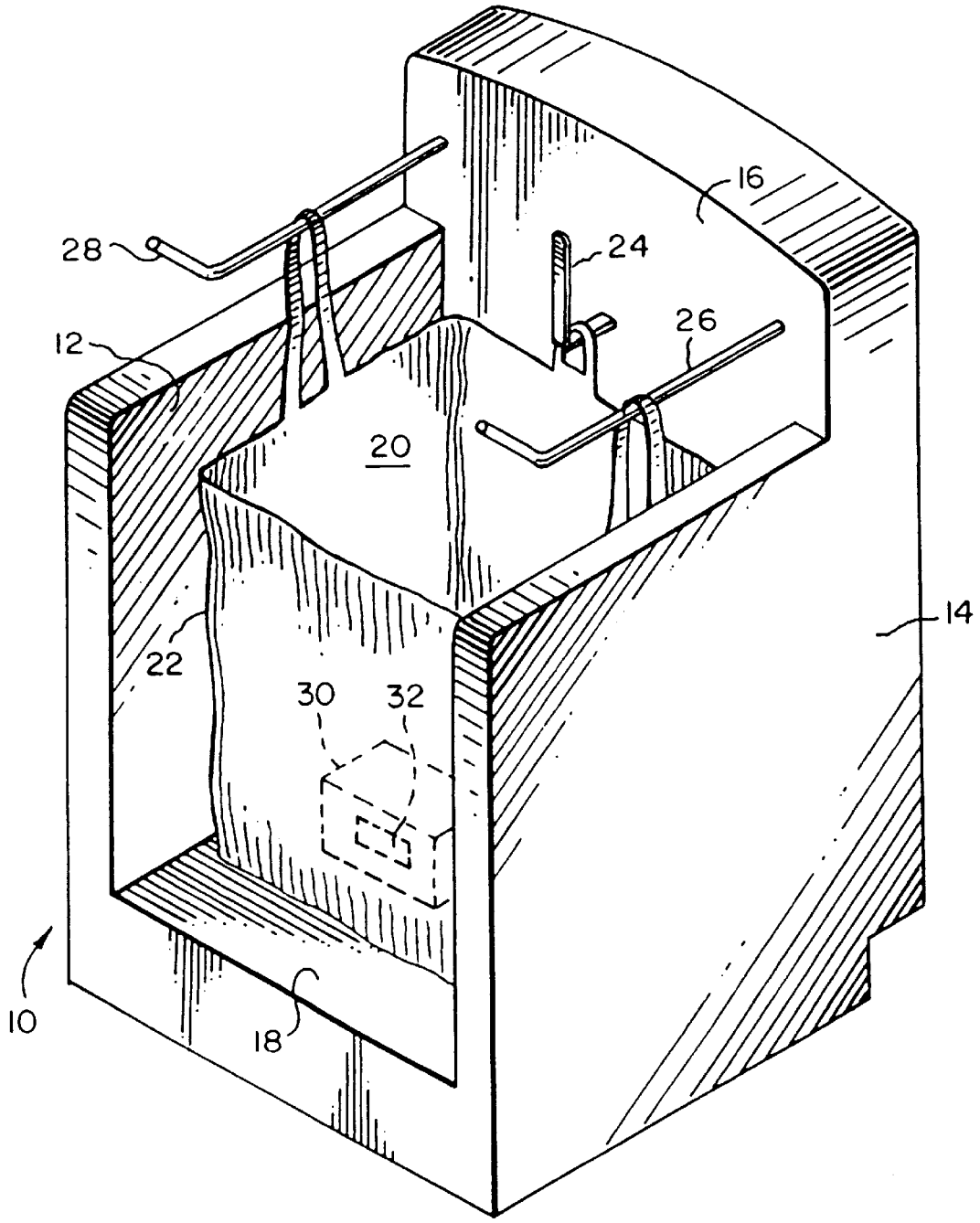
FIG. 1 is a perspective view of a bagging station having an EAS tag deactivation system according to one embodiment of the present invention.

Referring to FIG. 1, a bagging station 10 incorporating an EAS deactivation system according to one embodiment of the present invention is shown. Bagging station 10 has three sidewalls 12, 14, and 16 and a bottom 18 that define a volume 20 in which a shopping bag 22 or other bulk container can be placed. A quantity of plastic shopping bags can be placed on bulk holder 24 with their handles on bag racks 26 and 28 and then pulled out for use one at a time. Bulk holder 24 and bag racks 26 and 28 are mounted on sidewall 16. Shopping bag 22 contains article 30 which has an associated EAS tag 32 for use with an EAS system as is known in the art. Preferably EAS tag 32 is a magnetoacoustic EAS tag sold by the assignee of this application under the brand name "ULTRA•MAX®", such EAS tags are used widely for theft deterrence.

Figure 2:
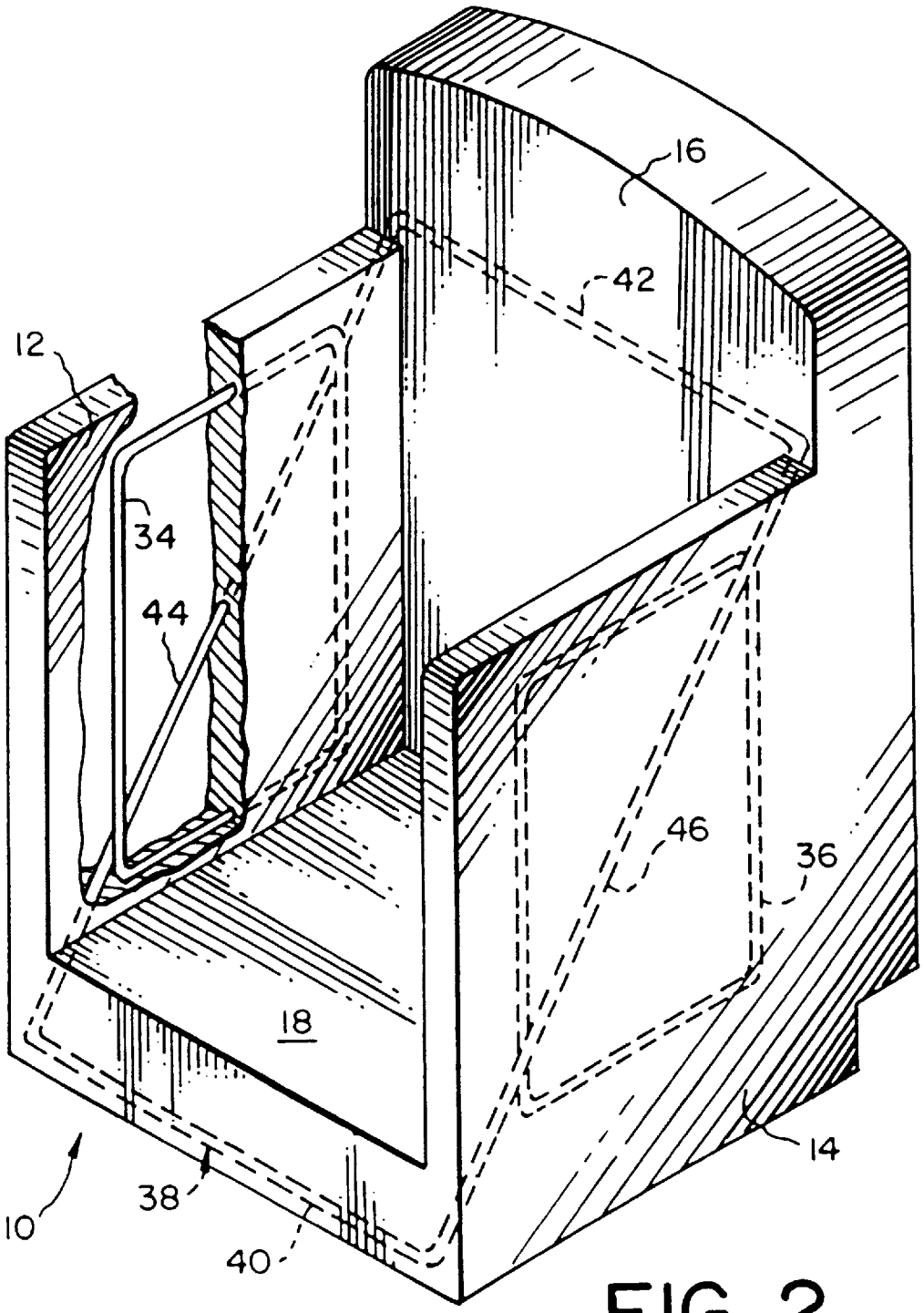
FIG. 2 is a perspective partially cut away view showing one embodiment of the deactivation coils in the bagging station of FIG. 1.

FIG. 2 shows a deactivation coil arrangement of the present invention for use with bagging station 10. Deactivation coil 34 is located inside sidewall 12, and deactivation coil 36 is located inside sidewall 14. Sidewalls 12 and 14 are parallel so that deactivation coils 34 and 36 are located in parallel planes. Deactivation coil 38 has four coil sections 40, 42, 44, and 46. Coil section 40 is located in bottom 18 near the front portion thereof, and coil section 42 is located in sidewall 16 near the top portion thereof. Coil sections 44 and 46 are located in sidewalls 12 and 14 respectively along the approximate respective diagonals of deactivation coils 34 and 36. A power supply which is shown in detail in FIG. 9 is connected to deactivation coils 34, 36, and 38 to provide them with electrical energy to create the magnetic fields to deactivate EAS tag 32. For example, in a bagging station having dimensions of approximately 36 centimeters by 36 centimeters by 51 centimeters, deactivation coils 34 and 36 consisted of twenty-one turns of AWG 10 copper wire and deactivation coil 38 consisted of thirty-three turns of AWG 10 copper wire. In this embodiment deactivation coils 34 and 36 were energized with a current of 450 amperes, and deactivation coil 38 was energized with a current of 750 amperes.

It should be noted that sidewalls 12 and 14 can be oriented at another angle so that deactivation coils 34 and 36 are not disposed in parallel planes. The angle between one of the planes in which one of deactivation coils 34 and 36 is located and another plane that is parallel to the plane in which the other of deactivation coils 34 and 36 is located is preferably less than approximately 15 degrees. If deactivation coils 34 and 36 are square, deactivation coil 38 is preferably located in a plane that intersects deactivation coils 34 and 36 at an angle of forty-five degrees and is collinear with the respective diagonals of deactivation coils 34 and 36. However, deactivation coil 38 does not have to be disposed in a plane that is collinear with the diagonals of deactivation coils 34 and 36 and can be located at other angles such that deactivation coil 38 is disposed in a plane that intersects deactivation coils 34 and 36 at an angle that is greater than zero degrees and less than ninety degrees. Preferably, deactivation coils 34, 36, and 38 are positioned inside sidewalls 12, 14, and 16 and bottom 18 as discussed above; however, they do not have to be located therein.

Figures 3A, 3B, 3C:
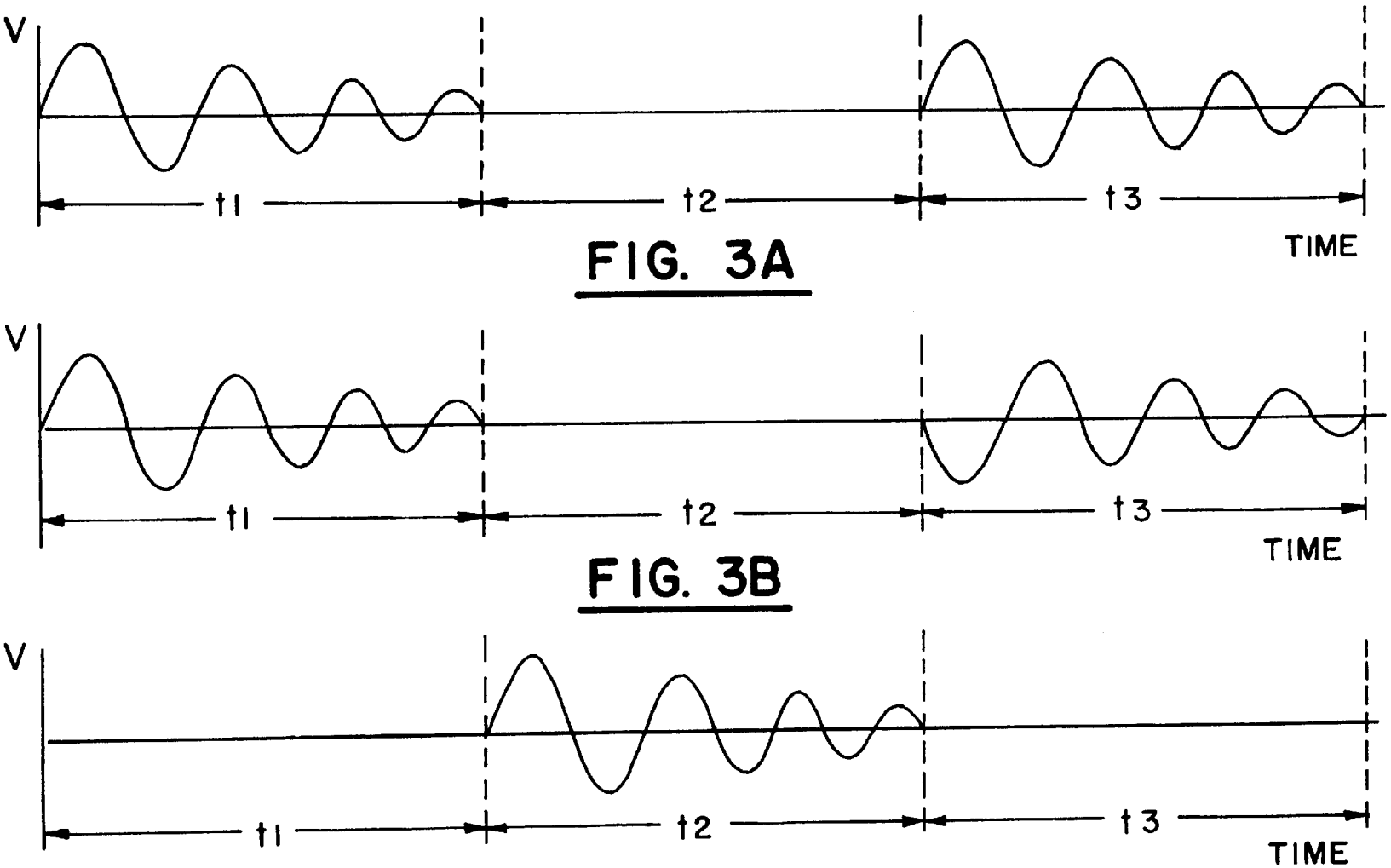
FIGS. 3A–3C are plots of waveforms displaying one embodiment of the energizing sequence of the deactivation coils of the present invention.

FIGS. 3A–3C show a plot of waveforms displaying a preferred embodiment of the energizing sequence of the deactivation coils of the present invention. The energizing signals for deactivation coils 34, 36, and 38 are illustrated in FIGS. 3A, 3B, and 3C respectively. During a first time period, t1, deactivation coils 34 and 36 are energized in phase with exponentially decaying sine wave signals. During a second time period, t2, deactivation coil 38 is energized with an exponentially decaying sine wave signal. During a third time period, t3, deactivation coils 34 and 36 are energized one hundred and eighty degrees out of phase with exponentially decaying sine wave signals. Other types of decaying signals such as a linearly decaying triangular wave can be used to energize the deactivation coils. In addition, the energizing sequence described above is a preferred embodiment, but other sequences can be used. For example, all three deactivation coils can be energized at one time, they can be energized one at a time, initially deactivation coils 34 and 36 are energized and then deactivation coil 38 is energized without the second energizing of deactivation coils 34 and 36 and so forth. It should also be noted that section 44 of deactivation coil 38 can be located in a front wall rather than in bottom 18 if an enclosed or partially enclosed front section of bagging station 10 is desired.

Figure 4:
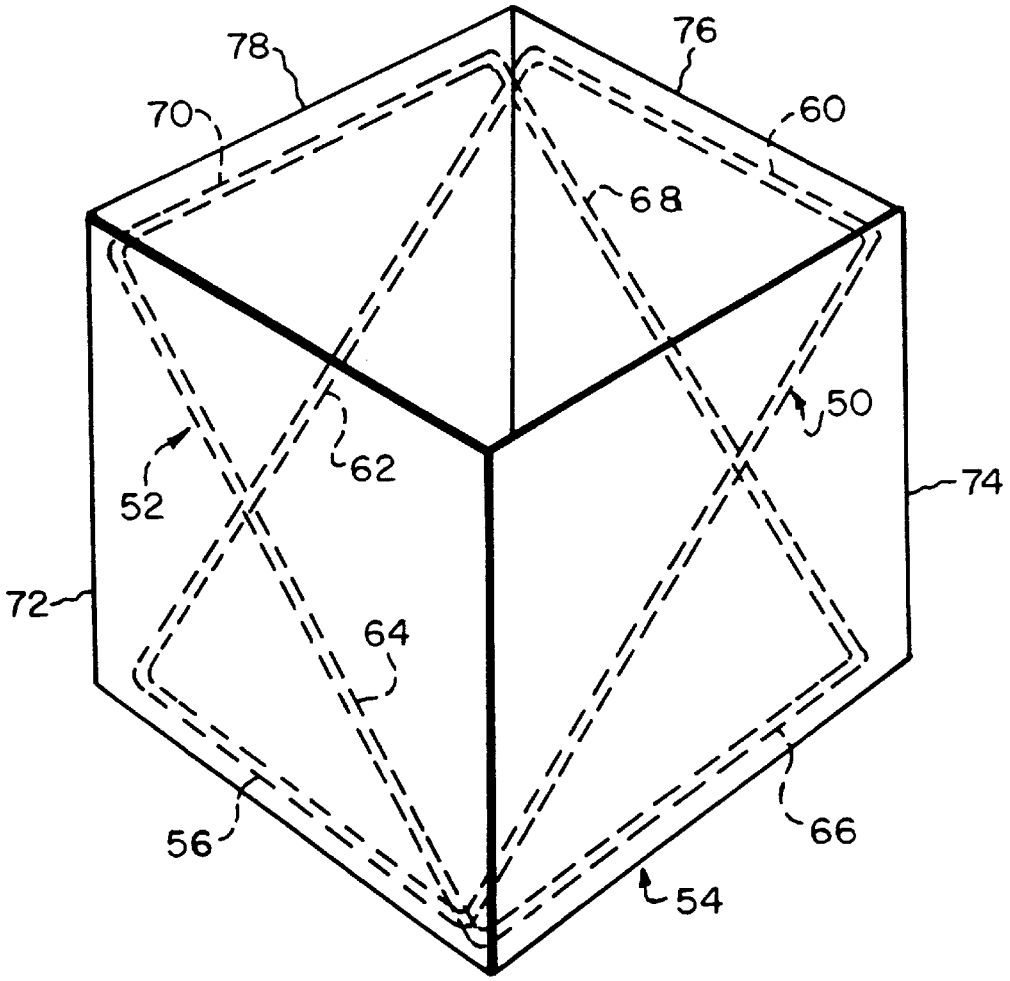
FIG. 4 is a perspective schematic view showing an alternative embodiment of the present invention.

FIG. 4 illustrates a perspective schematic view showing an alternative embodiment of the present invention. This embodiment employs only two deactivation coils 50 and 52. This embodiment is particularly suited to a bagging station having four sides as indicated by bagging station 54 which is indicated in dotted lines. Deactivation coil 50 has four coil sections 56, 58, 60, and 62, and deactivation coil 52 has four coil sections 64, 66, 68, and 70. Deactivation coil 50 is located in a first plane and deactivation coil 52 is located in a second plane that intersects the first plane so that coil section 56 of deactivation coil 50 is orthogonal to coil section 66 of deactivation coil 52. In addition, coil section 60 of deactivation coil 50 is orthogonal to coil section 70 of deactivation coil 52.

With reference to FIG. 4 and the partially cut away front, back and side views of bagging station 10 in FIGS. 5–8, coil section 56 is located near the bottom of sidewall 72, and coil section 64 is located approximately along the diagonal of sidewall 72. Coil section 66 is located near the bottom of sidewall 74, and coil section 58 is located approximately along the diagonal of sidewall 74. Coil section 60 is located near the top of sidewall 76, and coil section 68 is located approximately along the diagonal of sidewall 76. Coil section 70 is located near the top of sidewall 78, and coil section is located approximately along the diagonal of sidewall 78.

The embodiment of the present invention disclosed in FIGS. 4–8 is merely illustrative; deactivation coils 50 and 52 can be located in other positions. Coil sections 56 and 66 have been shown as being located in respective sidewalls 72 and 74, however, coil sections 56 and 66 could equivalently be located in a floor of bagging station 54. In addition, coil sections 56 and 66 could be located at positions other than near the bottoms of respective sidewalls 72 and 74. Coil sections 60 and 70 have been shown as being located near the top of respective sidewalls 76 and 78; however, coil sections could be located at positions other than near the top of respective sidewalls 76 and 78. Coil sections 58, 62, 64, and 68 have been shown as being located approximately along their respective sidewalls; however, other locations although not preferred could be used.

In one embodiment of a power supply for use with the present invention, a transformer has a primary winding and secondary winding. The primary winding is connected to a voltage regulator circuit which in turn is connected to a power line which provides an AC power source. The anode of the diode is connected to a first leg of the secondary winding, and the cathode of the diode is connected to a first node. A capacitor is connected across the first node and the second leg of the secondary winding. A voltage divider consisting of two resistors is also connected across the first node and the second leg of the secondary winding. A line is connected to a second node between the series connection of resistors and provides a feedback signal to the voltage regulator circuit indicative of the voltage across the capacitor. An electronic switch in series with a deactivation coil is also connected across the first node and second leg of the secondary winding. An electronic switch comprises four silicon controlled rectifiers (SCR's). Two of the SCR's are connected in a first antiparallel set, the other two SCR's are connected in a second antiparallel set, and these antiparallel sets are connected in series. The gate drive signals for the SCR's are provided by a gate drive circuit which provides simultaneous pulses across the gate and cathode of the SCR's.

The deactivation coil can be one of deactivation coils 34, 36, and 38 or any number in series. The electronic switch has two sets of SCR's connected in antiparallel for illustration. However, depending on the breakdown voltage of the SCR's used and the voltage across the capacitor, either a single set of SCR's in antiparallel or more than two sets can be used. In addition, the electronic switch can have multiple SCR's in each leg if the current required for the deactivation coil exceeds the current carrying capacity of the single SCR's. In addition, the capacitor can be a single capacitor, or it can comprise a bank of capacitors that are precharged to supply the energy level needed for the deactivation coil.

The current provided to the deactivation coil from the capacitor is an alternating current of decreasing magnitude, the resultant deactivation field created by the deactivation coil is an alternating decreasing magnetic field.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An apparatus for deactivating an electronic article surveillance tag associated with an article, said apparatus comprising: a housing defining a volume in which a bag can be placed for packaging said article; a first deactivation coil located in a first wall of said housing; a second deactivation coil located in a second wall of said housing; and a third deactivation coil located in said housing such that said third deactivation coil intersects said first and second deactivation coils at an angle that is greater than zero degrees and less than ninety degrees.

2. An apparatus as recited in claim 1, wherein said first and second walls are parallel.

3. An apparatus as recited in claim 2, wherein said third deactivation coil is collinear with a diagonal of said first and second deactivation coils.

4. An apparatus as recited in claim 3, wherein said third deactivation coil intersects said first and second deactivation coils at an angle of approximately forty-five degrees.

5. An apparatus as recited in claim 3, wherein said apparatus further comprises means for energizing said first, second and third deactivation coils.

6. An apparatus as recited in claim 5, wherein said energizing means energizes said first and second deactivation coils simultaneously such that said first and second deactivation coils are in phase.

7. An apparatus as recited in claim 6, wherein said third deactivation coil is energized after said first and second deactivation coils are energized.

8. An apparatus as recited in claim 7, wherein said first and second deactivation coils are energized simultaneously a second time such that said first and second deactivation coils are 180 degrees out of phase.

9. An apparatus as recited in claim 5, wherein said energizing means provides an exponentially decaying sine wave to said first, second, and third deactivation coils.

10. An apparatus as recited in claim 3, wherein said apparatus further comprises means for energizing said first, second, and third deactivation coils.

11. An apparatus as recited in claim 10, wherein said energizing means energizes said first and second deactivation coils simultaneously such that said first and second deactivation coils are in phase.

12. An apparatus as recited in claim 11, wherein said third deactivation coil is energized after said first and second deactivation coils are energized.

13. An apparatus as recited in claim 12, wherein said first and second deactivation coils are energized simultaneously a second time such that said first and second deactivation coils are 180 degrees out of phase.

14. An apparatus as recited in claim 10, wherein said energizing means provides an exponentially decaying sine wave to said first, second and third deactivation coils.

15. An apparatus as recited in claim 1, wherein said first and second deactivation coils are not parallel and the angle between said second deactivation coil and a plane that is parallel to said first deactivation coil is less than approximately fifteen degrees.

16. An apparatus as recited in claim 15, wherein said third deactivation coil is collinear with a diagonal of said first deactivation coil.

17. An apparatus for deactivating an electronic article surveillance tag associated with an article, said apparatus comprising: a housing defining a volume in which a bag can be placed for packaging said article, said housing having first and second sides that are opposite each other and third and fourth sides that are opposite each other; a first deactivation coil located in said housing such that said first deactivation coil intersects said first and second sides at an angle that is greater than zero degrees and less than ninety degrees; and a second deactivation coil located in said housing such that said second deactivation coil intersects said third and fourth sides at an angle that is greater than zero degrees and less than ninety degrees.

18. An apparatus as recited in claim 17, wherein said first deactivation coil intersects said first and second walls on the diagonal of said first and second walls.

19. An apparatus as recited in claim 18, wherein said second deactivation coil intersects said third and fourth walls on the diagonal of said third and fourth walls.

* * * * *